United States Patent [19]

Hickman

[11] Patent Number: 4,617,770

[45] Date of Patent: Oct. 21, 1986

[54] NAILERLESS ROOF EDGE, FRAMING STRUCTURE AND BUILDING PANEL MOUNTING ASSEMBLY

[75] Inventor: John B. Hickman, Asheville, N.C.

[73] Assignee: W. P. Hickman Co., Asheville, N.C.

[21] Appl. No.: 654,647

[22] Filed: Sep. 25, 1984

Related U.S. Application Data

[63] Continuation-in-part of Ser. No. 534,268, Sep. 22, 1983, Pat. No. 4,472,913, which is a continuation of Ser. No. 191,714, Sep. 28, 1980, abandoned.

[51] Int. Cl.[4] ..... E06B 2/04; E04B 5/52

[52] U.S. Cl. ..... 52/214; 52/475; 52/735

[58] Field of Search ..... 52/712, 714, 716–718, 52/475–477, 211, 214, 213, 775, 776, 735

[56] References Cited

U.S. PATENT DOCUMENTS

| | | | |
|---|---|---|---|
| 981,937 | 1/1911 | Ohnstrand | 52/718 |
| 2,840,202 | 6/1958 | Hehr | 52/214 |
| 2,902,727 | 9/1959 | Samolis | 52/214 |
| 2,955,688 | 10/1960 | Karlstrom | 52/475 |

FOREIGN PATENT DOCUMENTS

| | | | |
|---|---|---|---|
| 900279 | 5/1972 | Canada | 52/775 |
| 1499116 | 1/1978 | United Kingdom | 52/214 |

*Primary Examiner*—James L. Ridgill, Jr.
*Attorney, Agent, or Firm*—Harness, Dickey & Pierce

[57] ABSTRACT

This disclosure relates to a roof edge assembly for use in forming a raised edge or gravel stop on a roof. The disclosure also relates to a framing structure useful for framing windows and doors; and to a mounting assembly for securing building panels, curtain walls, partitions, siding and the like to building surfaces. The nailerless roof edge of the present invention eliminates the need for the piece of wood or nailer which is normally bolted to the top of a cement block wall for the purpose of fastening metal roof edges. The present roof edge assembly comprises a tab strip member which is adapted to be secured adjacent the edge of a roof using adhesive or other attaching means and which has special tab means thereon. The assembly further comprises a cant member having slot means therein adapted to mate with the tab means to secure the cant member to the tab strip member, and a fascia member which is adapted to be mounted on the cant member. The present invention provides for relatively simple, fast, and economical installation of roof edging and is adaptable to conventional roofing sealing membrane and insulation configurations. The framing structure employs a similar tab strip member for securing as with adhesive to a building surface adjacent the window or doorway opening. A frame member, having slotted openings or raised clip members, engages the tab strip to hold the frame member in place on the building structure, while a cover member can be snap fit onto the frame member to conceal the tabs. A similar tab strip is also used to secure other building materials to a building structure, wherein the building material is provided with slotted openings or raised clip members for engaging the tab strip.

17 Claims, 45 Drawing Figures

FIG. 4a.
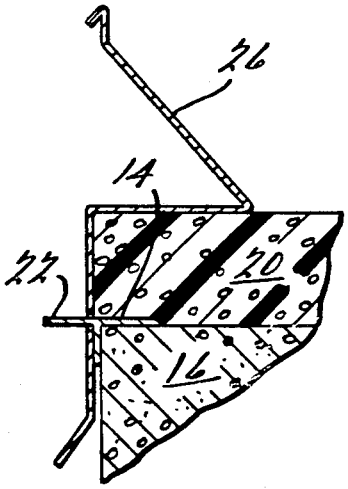
FIG. 4b.
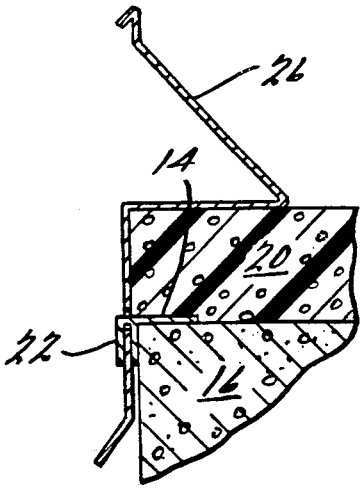
FIG. 5a.
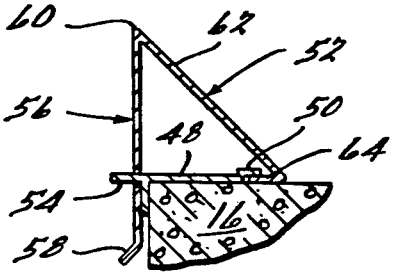
FIG. 5b.
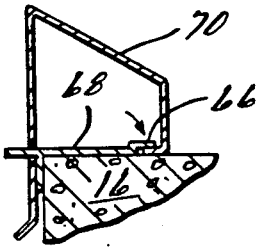
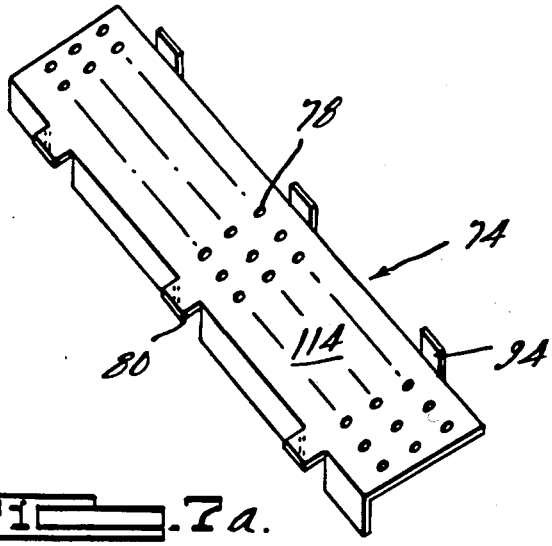
FIG. 7a.
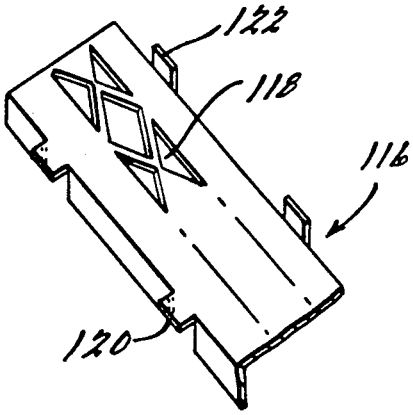
FIG. 7b.

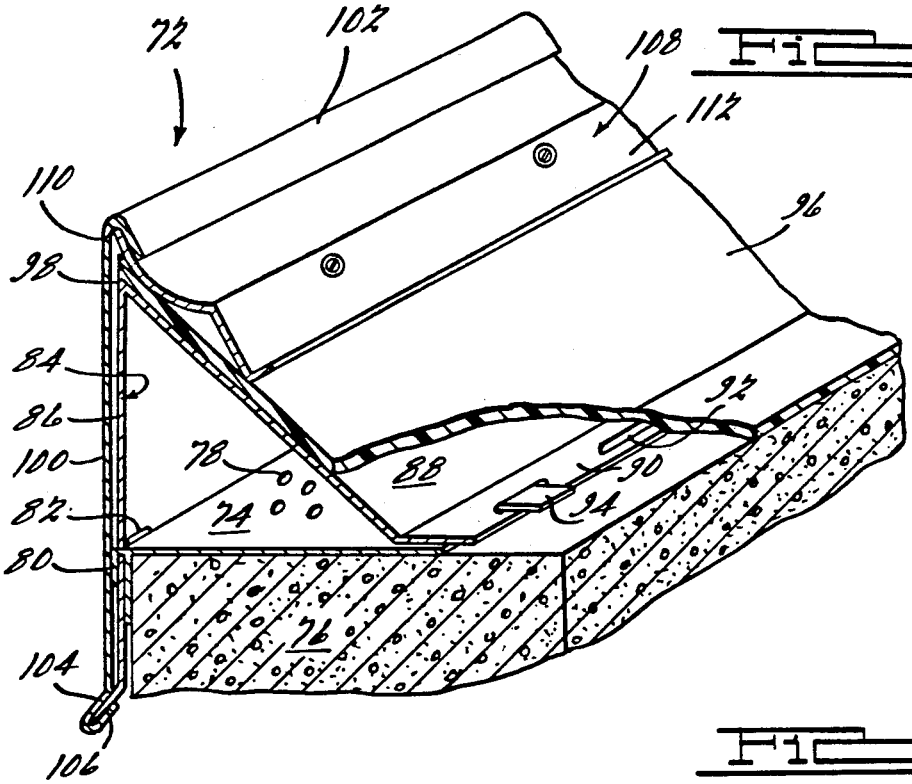
FIG. 6.
FIG. 8b.
FIG. 7c.
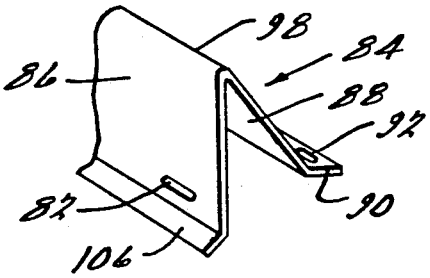
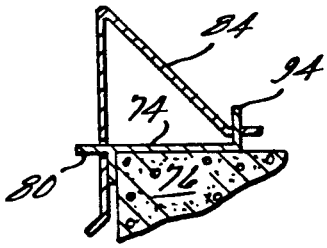
FIG. 8a.
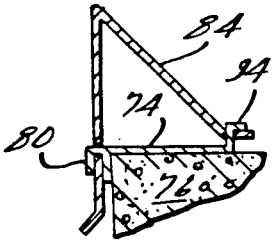
FIG. 9b.
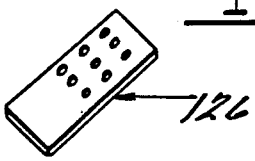
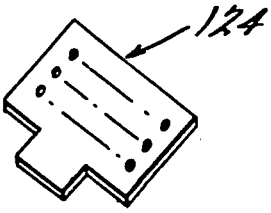
FIG. 9a.
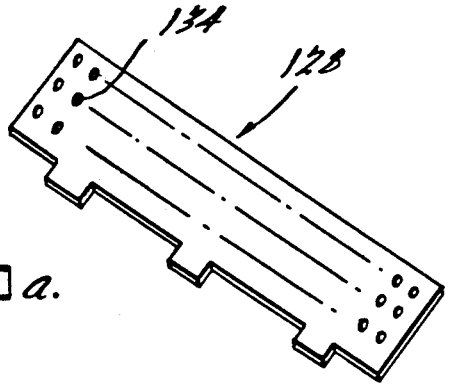
FIG. 10a.

136
130
138

140
132

142
146
148
144

156
150
154
152
158
160
162
164
166
168

174
170
172
180
176
178

190
192
198
196
194

182
186
184
188

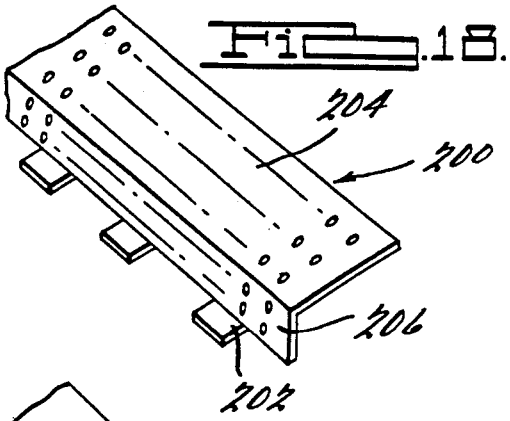
FIG. 18.
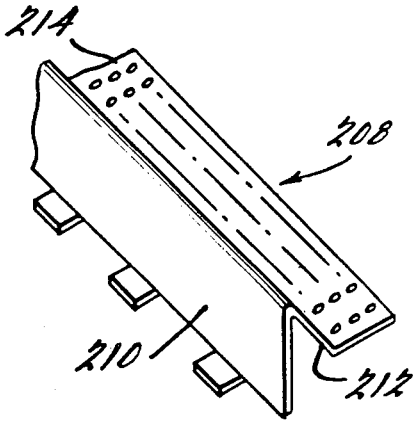
FIG. 19.
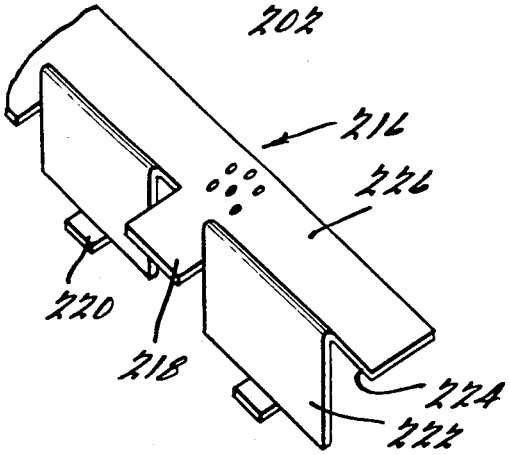
FIG. 20.
FIG. 21.
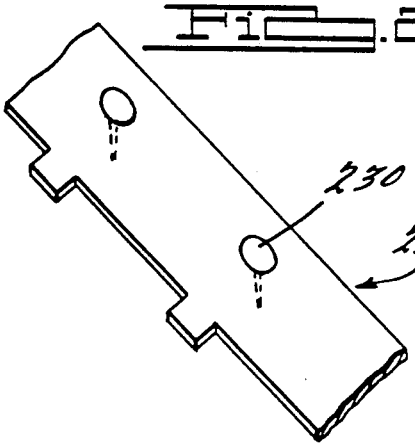
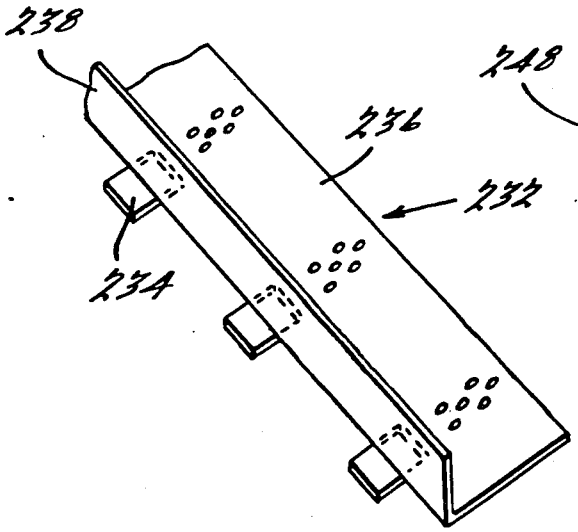
FIG. 22.
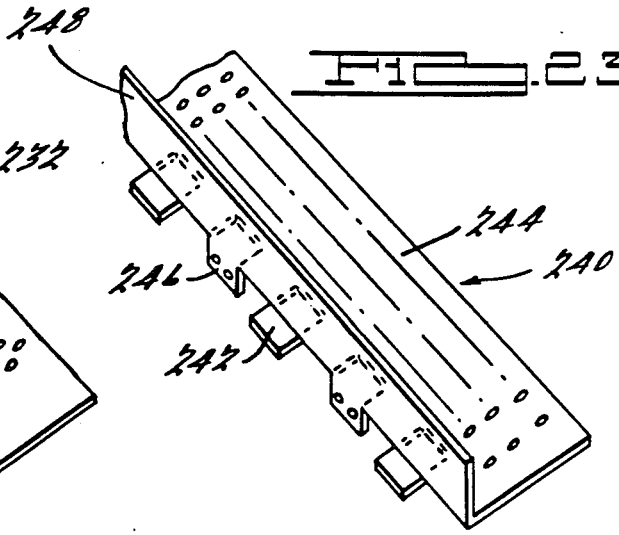
FIG. 23.

NAILERLESS ROOF EDGE, FRAMING STRUCTURE AND BUILDING PANEL MOUNTING ASSEMBLY

CROSS REFERENCE TO RELATED APPLICATIONS

This application is a continuation-in-part of copending application Ser. No. 534,268, entitled "Nailerless Roof Edge", filed Sept. 22, 1983, U.S. Pat. No. 4,472,913, which was a continuation of application Ser. No. 191,714, filed Sept. 28, 1980, now abandoned; both of said applications being herein incorporated by reference. Priority of said copending applications is claimed under 35 U.S.C. 120.

BACKGROUND OF THE INVENTION

The present invention pertains primarily to building structures and more particularly to roof edge construction, window and door frame construction and building panel, curtain wall and partition construction. Reference may be had to U.S. Pat. Nos. 4,071,987 and Re. 26,056, both owned by the same assignee as the present invention, to show treatment for the raised edge or gravel stop, and fascia at the top edge of a building. The disclosures of these two above-referenced patents are hereby incorporated in this application by reference.

It has generally been the practice in the erection of buildings having brick or cement block walls and metal roof edging, to bolt a piece of wood or nailer to the edge of the building on top of the last row of bricks or cement blocks. Metal edging is then fastened to this wood nailer. As simple as this procedure may appear in this over-simplified summary, the actual step-by-step process is very involved and requires the coordination of several workers, as will be explained below.

In order to get a wood stud or nailer in its desired location, first a wall is made, for example, out of cement blocks. When the wall is completed, steel J-bolts or threaded rods are embedded into the voids or cavities in the top row of blocks using concrete or the like. This contractor, typically a mason, usually fits a nut onto the exposed end of the threaded rod or bolt so that once the concrete has set, removing the nut will knock any rust off, since a clean threaded end is needed. Once the bolts are set and secured in place, a carpenter arrives at the job site with boards, generally 2×4's, 2×8's, or whatever width is needed. The carpenter must carefully drill and countersink these boards on exactly the right centers, remove the nuts from the exposed, threaded studs, drop the boards in place over the studs, and then, using a washer and the nut removed earlier, tighten the board down. This board, known as a nailer, is generally of pressure threated wood to retard rot. Finally, since it is difficult to set the studs exactly right, a steel worker is sometimes required to burn off the exposed ends of the studs which protrude above the top of the nailer. After all this has been completed, metal roof edging, of a type shown in the two above-referenced patents, for example, is fit into place by a sheet metal worker, who attaches a metal mounting member of some type to the wood studs using nails or the like.

It should thus be readily apparent that in addition to being a labor and time consuming effort, the above-described procedure also requires the coordination of four trades, namely a mason, a carpenter, a steelworker, and finally a sheet metal worker. In this day of "fast track" construction, the fewer trades that depend upon each other, the faster the schedule can be made. A fast schedule and rapid completion of construction projects saves money because contruction loans do not have to be carried as long at current high interest rates. In addition, the complexity of the overall project is reduced significantly.

Accordingly, it is a principal object of the present invention to provide an improved roof edge assembly which eliminates the need for the piece of wood or nailer which is normally bolted adjacent the edge of a roof for the purpose of fastening metal roofing edges.

In general, the nailerless roof edge according to the present invention contemplates the use of a tab strip member which is adapted to be secured adjacent the edge of a roof on top of a block wall or the like. Since the wood nailer previously used in the art is eliminated, the tab strip member, which has tab means thereon, is secured directly to the edge of the roof using adhesive or other attaching means. The present roof edge assembly further comprises a cant member having slot means therein adapted to mate with the tab means to secure the cant member to the tap strip member, and also comprises a fascia member which is adapted to be mounted on the cant member.

The tab strip member may comprise a semi-flexible perforated strip with tabs protruding from it so that a slotted cant member can be slid over the tabs, with the tabs then being bent or hammered down to lock the cant member in place. Although several different embodiments of the present invention are described herein, it should be appreciated that other variations or modifications are possible. In one tab strip configuration described herein, tabs protrude out of only one side of the tab strip member, while in another configuration, tabs protrude out of both sides of the tab strip member. As will be explained in more detail hereinbelow, these two different tab configurations are adapted for use with matching slotted cant members.

In securing window frames and door frames to a building structure, it is similarly desirable to eliminate the use of wood framing structures. Wood framing is generally expensive and not well suited for use on masonry and steel buildings. Securing wood framing structures to masonry walls presents many of the same problems encountered with wood nailers discussed above.

Accordingly, it is another object of the present invention to provide an improved framing structure which eliminates the need for wooden window frames, door frames and the like. In accordance with the present invention, an assembly for use in mounting a framing member to a building having an opening, such as a doorway or window opening, comprises a relatively flexible tab strip member having integral tab means thereon. The tab strip is secureable to a surface of the building, adjacent the opening, and the tab means includes a portion protruding in a direction generally away from the building surface. A frame member has an integrally formed means for mating with the tab means, to secure the frame member to the tab strip member. The mating means has a means for receiving the protruding portion of the tab means. The frame has first and second edges and has a means for supporting the frame member within the opening of the building. A cover member is also provided which has means for engaging the first and second edges of the frame member to secure the cover member to the frame member. In one embodiment the tab means protrude generally perpendicularly to the tab strip, and the frame member is provided with an aperture for receiving the protruding portion of the tab. In another embodiment, the tab means defines an elongated finger disposed along the longitudinal dimension of the tab strip, and wherein the frame member is provided with integrally formed clip means for mating with the elongated finger tab means.

The invention further finds utility as a means for securing building panels, curtain walls, partitions, and the like to the wall surface of a building. Thus it is another object of the present invention to provide an improved mounting device for securing a building panel, partition or the like to a building surface. In general, the mounting device according to the present invention employs a relatively flexible tab strip member having integral tab means thereon and being secureable to a surface of the building. The tab means includes a portion protruding generally outwardly from the building surface. A building panel having means for mating with the tab means to secure the panel member to the tab strip member is provided, wherein the means for mating has a means for receiving the protruding portion of the tab means. The building panel has first and second parallel edges and has a channel element along the first edge adapted for interfitting engagement with another similarly constructed building panel. The mounting assembly thus eliminates the need to use conventional brick tie structures which must be placed in the masonary wall, as between mortar joints, when the wall is first constructed.

Additional advantages and features of the present invention will become apparent from a reading of the detailed description of the preferred embodiments which makes reference to the following set of drawings in which:

BRIEF DESCRIPTION OF THE DRAWINGS

FIGS. 4*a* and 4*b* are end views of the cant member of FIG. 1 mounted on the tab strip member of FIG. 1, both prior to and after, respectively, the protruding tab has been bent down;

FIGS. 5*a* and 5*b* are end views of two alternate cant member configurations, shown with a tab strip member having an offset horizontal element at its rearward end;

FIG. 6 is a perspective view, partially in section, of another preferred embodiment of the nailerless roof edge assembly of the present invention, shown mounted on the edge of a roof;

FIGS. 7*a*, 7*b*, and 7*c* are perspective views of two tab strip members and a cant member, respectively, of the type shown in FIG. 6;

FIGS. 8*a* and 8*b* are end views of the cant member of FIG. 6 mounted on the tab strip member of FIG. 6, both before and after, respectively, the protruding tabs have been bent down;

FIGS. 9*a*, 9*b*, 10*a*, 10*b* and 10*c*, as well as FIGS. 11 to 27 show various tab strip member configurations suitable for use with the present invention.

FIG. 36 is a perspective view showing another embodiment of building panel mounting assembly useful in securing curtain wall panels or siding to a masonry wall or the like.

DESCRIPTION OF THE PREFERRED EMBODIMENTS

Figure 1:
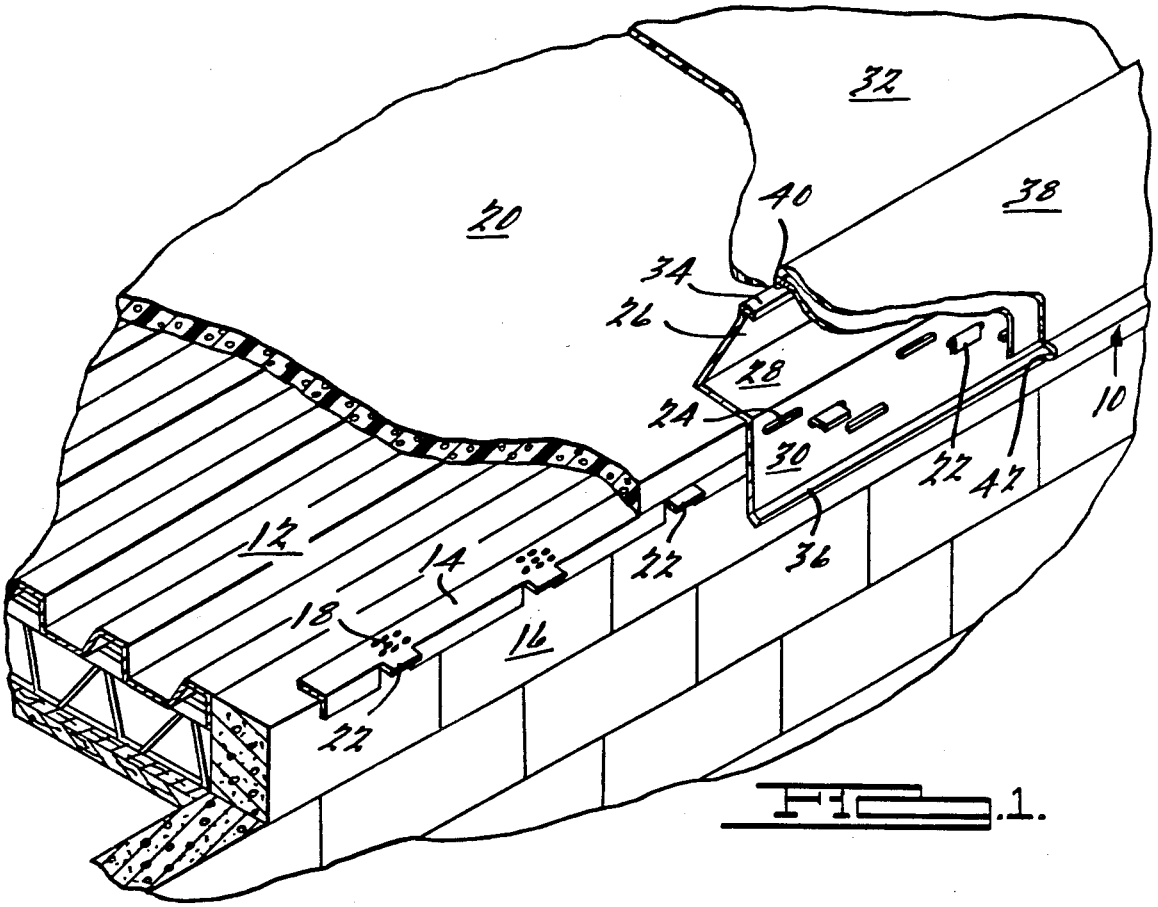
FIG. 1 is a perspective view, partially in section, of one preferred embodiment of the nailerless roof edge assembly of the present invention, shown mounted on a building.

Referring now to the drawings wherein the showings are for the purpose of illustrating several preferred embodiments of the present invention and are not for the purpose of limiting the invention, FIG. 1 shows one preferred embodiment of the nailerless roof edge assembly 10 of the present invention which is used to form a raised edge or gravel stop on a roof deck 12. This embodiment is particularly suited to be used with a gravel stop of the type described in U.S. Pat. No. 4,071,987, referred to hereinabove. A tab strip member 14 is secured to a top row of cement blocks 16 on the edge of a roof using adhesive or the like. The adhesive is allowed to flow somewhat through perforations 18 in the tab strip member 14 to improve adhesion. The extension of the adhesive through the perforations, while providing some additional holding force, primarily shortens the time required to set up the adhesive. Insulation 20 is then placed on top of the roof deck 12 and overlaps the upper horizontal surface of the tab strip member 14. The tab strip member 14 has a series of tabs 22 thereon which are mated with slots 24 in cant member or spring clip member 26. The cant member 26 is installed by positioning its lower horizontal supporting portion 28 on top of the insulation pad 20 and then sliding its vertical portion 30 into engagement with the top row of cement blocks 16. Of course, the slots 24 in the cant member would have to be aligned with the mating tabs 22 in the tab strip member 14 before the vertical portion 30 of the cant member could be brought up against the blocks 16. As shown in this figure, once the cant member has been placed along the vertical surface adjacent the roof, the tabs 22 are then bent or hammered down to secure the cant member 26 to the tab strip member 14.

Once the cant member or spring clip member is secured, a roofing sealing membrane 32 of elastomeric material or tar paper is placed on top of insulation 20. The roofing member 32 is brought up over the top edge 34 of the cant member 26 and is allowed to extend down to near the bottom edge 36 of the cant member. A fascia member 38, having a top channel element 40 and a bottom channel element 42 which face in opposite directions generally toward each other, is then positioned on the top edge of the cant member. The cant member is then deflected downwardly and released so as to have its top and bottom edges 34 and 36 respectively, enter the facing channel elements 40 and 42 respectively of the fascia member 38. Although not shown in FIG. 1, gravel is typically placed on top of the roofing sealing membrane 32.

Figure 2:
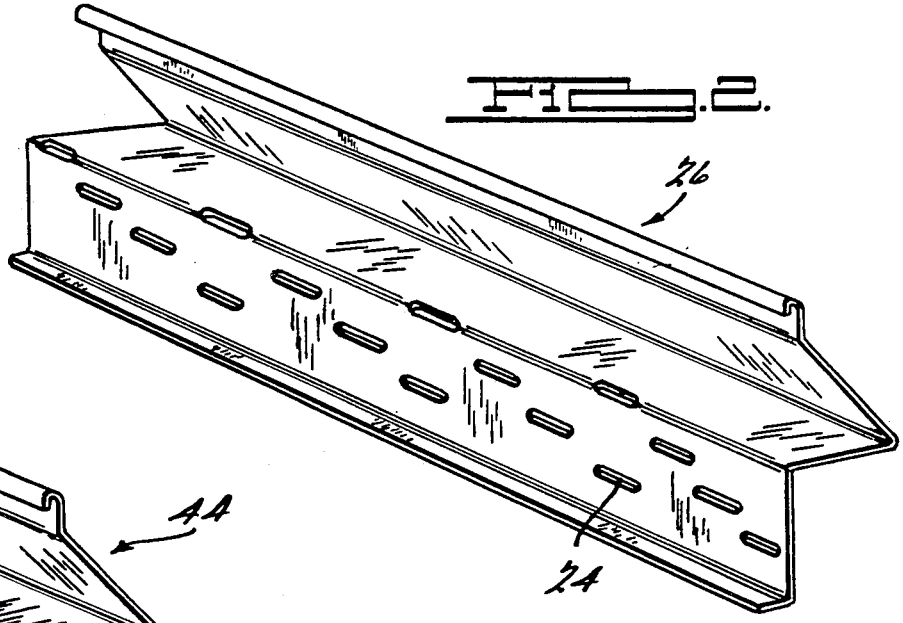
FIG. 2 is a perspective view of the cant member or spring clip member shown in FIG. 1.
Figure 3:
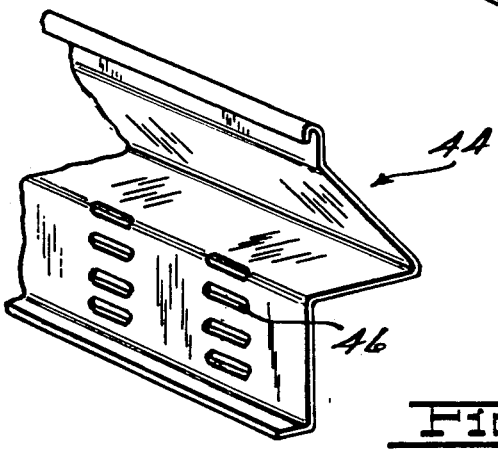
FIG. 3 is a perspective view of a cant member showing another possible slot configuration.

Referring now to FIGS. 2 and 3, two different arrangements of slots are shown in cant members 26 and 44 respectively. In both arrangements the slots appear at various levels to accommodate different thicknesses of insulation which would be installed under the slotted cant member. FIG. 2 shows slots 24 in a staggered arrangement, whereas a FIG. 3 shows slots 46 in an in-line arrangement. From a manufacturing point of view, it is believed that staggered slots may be preferred, although both arrangements provide slots at at least four different levels. For custom insulation thicknesses, only one row of slots might be needed,, and that row could be prefabricated at the factory to meet specific job conditions.

FIG. 4*a* illustrates the cant member 26 and the tab strip member 14 of FIG. 1 before the protruding tab 22 has been bent down. FIG. 4*b* illustrates the same cant member and tab strip member after the protruding tab 22 has been bent down to secure the cant member in place.

FIG. 5*a* shows a tab strip member 48 which has an offset horizontal element 50 at its back end which is adapted to engage a cant member or spring clip member 52. The forward side of this cant member 52 is slotted in a manner similar to the cant member of FIG. 1 so as to mate with a tab 54 in the tab strip member, and has a generally planar vertical portion 56 which extends from a bottom edge 58 to a top edge 60, before joining an angular portion 62 which slopes rearwardly to join a back leg 64 which engages the offset element 50 to support the cant member along the horizontal edge of the roof. FIG. 5*b* shows a somewhat similar construction in which an offset horizontal portion 66 on a tab strip 68 may be bent down, as indicated by the arrow, after cant member 70 is in place.

FIG. 6 shows another preferred embodiment of the nailerless roof edge assembly 72 of the present invention. This embodiment is particularly suited to be used with a combination water dam and gravel stop of the type described in U.S. Pat. No. Re. 26,056, referred to hereinabove. In this embodiment, a tab strip member 74 is secured to a top row of cement blocks 76 on the edge of a roof using adhesive or the like, which is allowed to flow somewhat through perforations 78 in the tab strip member 74 to improve adhesion. Although not shown in this figure, insulation, such as that illustrated in FIG. 1 may be placed on top of the roof deck so as to overlap the upper horizontal surface of the tab strip member 74 at its back end. The tab strip member 74 has a series of tabs 80 on its forward end which are mated with slots 82 in cant member 84. Cant member 84, which is generally in the shape of an inverted −V, has a vertical portion 86 having slots 82 near its bottom edge 106 which mate with tabs 80, and an angular portion 88, which has a horizontal support flange 90 on its rearwardmost end. Flange 90 has slots 92 therein which mate with tabs 94 formed on the rearward end of tab strip member 74. The flange 90 supports the cant member 84 along the horizontal edge of the roof.

Once the cant member or spring clip member 84 is secured, a roofing sealing membrane 96 is placed on top of the roof and brought up near the top edge 98 of the cant member. A fascia member 100, having a top channel element 102 and a bottom channel element 104 which face in opposite directions generally toward each other, is then positioned on the bottom edge 106 of the cant member, and moved so that the top channel element 102 engages the top edge 98 of the cant member 84. Although not absolutely necessary to the practice of the present invention, a rocker flashing 108 may be used to further secure the fascia member 100 to the cant member. As shown in FIG. 6, an upper edge 110 of the flashing 108 projects into the channel 102, with a lower portion 112 of the flashing being fastened to the angular portion 88 of the cant member 84 to secure the roof edge assembly. Gravel is then typically placed on top of the roofing sealing membrane 96. This particular configuration is explained in greater detail in U.S. Pat. No. Re. 26,056, as referred to above.

Referring now to FIGS. 7*a* and 7*b*, two different types of tab strip members are shown. The tab strip member 74 of FIG. 7*a* comprises a generally planar horizontal portion 114 having perforations 78 therein, a first set of horizontally extending tabs 80 on its forward edge, and a second set of vertically extending tabs 94 on its rearward edge. The tab strip member 116 of FIG. 7*b* is of a configuration generally similar to that of the tab strip member of FIG. 7*a*, however, rather than being perforated, the generally planar horizontal portion 118 is made of expanded metal. Both a first and second set of tabs 120 and 122, respectively, are used in this configuration. An expanded metal version is particularly attractive due to the fact that since the metal is laterally stretched, it goes further. Thus the final piece costs less.

FIG. 7*c* more clearly shows the cant member 84 of FIG. 6. As described in connection with FIG. 6, this cant member comprises a vertical portion 86 joining a bottom edge 106 to a top edge 98. An angular portion 88 extends in a downward angle from the top edge 98 down to the horizontal support flange 90. Slots 82 are present in the vertical portion, while slots 92 are present in the horizontal flange 90. As with the cant member described in connection with FIG. 1, a variety of slot configurations may be fabricated into the cant member to accommodate various thicknesses of insulation or other structural variations. As before, the slots may simply be prefabricated in certain pre-specified locations to meet specific job conditions.

FIG. 8*a* illustrates the cant member 84 and the tab strip member 74 of FIG. 6 before the protruding tabs 80 and 94 have been bent down. FIG. 8*b* illustrates the same cant member and tab strip member after the protruding tabs have been bent down to hold the cant member in place.

It should be course be appreciated that the specific configurations of both the tab strip member and the cant member used with the present invention may be varied as necessary to suit particular needs. The following are examples of various tab strip member configurations which are adaptable for use with either of the preferred embodiments described above. Of course, an additional rearward tab would have to be added to accommodate a configuration of the type shown in FIG. 6.

FIGS. 9*a* and 9*b* illustrate tab strip members 124 and 126 respectively, which are of unit configuration. Such unit tab strips, which include a single tab thereon, could be individually positioned as necessary along a roof edge, thus eliminating the need for a single long tab strip having several tabs thereon. These tab strip members are shown as having perforations therein which aid in attachment to the edge of a roof.

Figures 10B, 10C, 11, 12, 13, 14, 15, 16, 17:
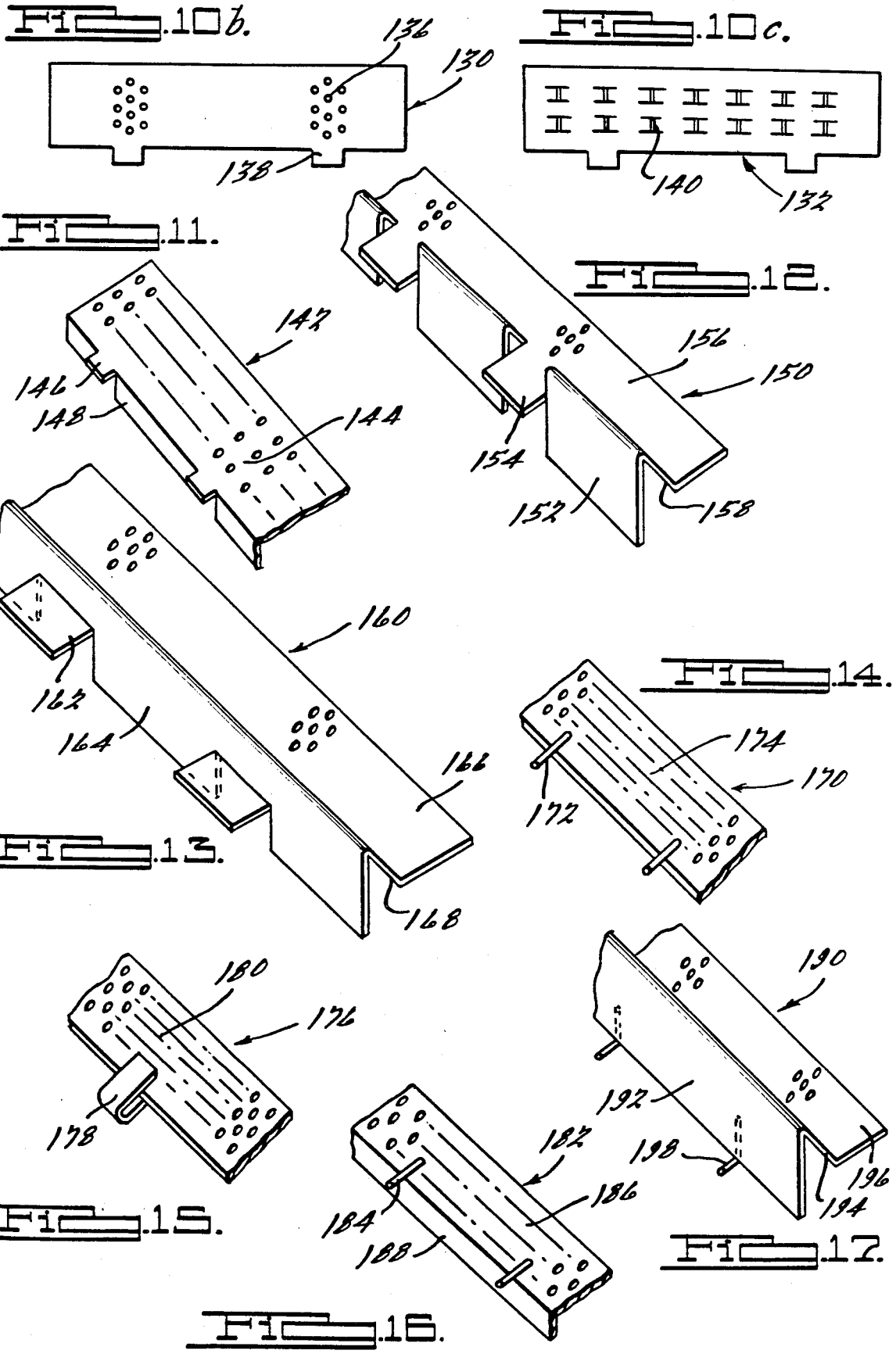

FIGS. 10*a*, 10*b* and 10*c* all show flat tab strip members 128, 130 and 132, respectively. However, different types of perforations are shown in each figure. FIG. 10*a* shows perforations 134 which are continuous over the horizontal portion of the strip, whereas the perforations 136 shown in FIG. 10*b* are localized on the horizontal portion of the strip adjacent the tabs 138. Perforations of the type shown in FIGS. 10*a* and 10*b* may be formed by punching out small holes in the sheet metal. However, as an alternative to punched-out perforations, FIG. 10*c* shows a tab strip member 132 where the sheet metal has been burst or pierced to give the desired holes 140 in the horizontal portion of the strip.

FIG. 11 illustrates a tab strip member 142 of the type shown in FIG. 1 wherein the strip is formed so as to contain a horizontal portion 144, tabs 146 coplanar and integral with the horizontal portion, and a series of downwardly-extending vertical flaps 148 which are formed out of the same piece of strip stock as the horizontal portion. The vertical flaps 148 are generally perpendicular to the horizontal portion 144. This particular configuration, as well as many of the others described herein, may also be used upside-down so that the vertical flaps extend upwardly.

FIG. 12 illustrates a tab strip member 150 wherein generally planar vertical flaps 152 extend both above and below the horizontal portion 156. Tabs 154 are coplanar and integral with the horizontal portion 156. The top edge of the vertical flaps joins an angular ramp 158 which is formed adjacent the horizontal portion. The ramp has its base on the horizontal portion and is inclined up to a point of contact with the top edge of the vertical flaps. FIG. 13 shows a tab strip member 160 somewhat similar to FIG. 12, however the tabs 162 are formed out of a vertical portion 164 rather than from a horizontal portion 166. The tabs 162 are still generally coplanar with the horizontal portion. The vertical portion 164 has a ramp 168 on its rearward side and extends both above and below the horizontal portion 166.

FIG. 14 illustrates a compound or "two-piece" tab strip member 170 wherein the tabs 172 comprise wires or bolts or the like which are secured to the horizontal strip 174 by such methods as soldering, gluing, brazing, welding, etc. FIG. 15 illustrates another compound tab strip member 176 wherein the tabs 178 comprise a metal strip folded over so that it contacts both the upper and lower surfaces of the horizontal portion 180 of the strip. The metal strip forming the tabs 178 may likewise be soldered, glued, brazed, welded, etc. to the horizontal portion 180 of the strip.

FIG. 16 illustrates a compound, formed tab strip member 182 wherein wire or bolt tabs 184 are attached to a strip having a continuous horizontal portion 186 and a downwardly extending vertical portion 188 which is generally perpendicular to the horizontal portion. This configuration is also particularly suited for use upside-down. FIG. 17 illustrates another compound, formed tab strip member 190 which is somewhat similar to the configuration of FIG. 13 in terms of its vertical portion 192, ramp 194, and horizontal portion 196. However, rather than having forward tabs as in FIG. 13, the configuration of FIG. 17 uses wire or bolt tabs 198, which are generally L-shaped and attached to the back side of the vertical portion 192, as shown.

FIG. 18 illustrates a tab strip member 200 wherein tabs 202 are offset from rather than coplanar with the horizontal portion 204 such that the tabs 202, vertical portion 206, and horizontal portion 204 form a step-like configuration. It is also noteworthy that this particular configuration shows perforations on both the horizontal and vertical portions, although both sets of perforations are not necessary to the practice of the present invention. It should of course be appreciated that such a distribution of perforations is equally adaptable to the other tab strip configurations disclosed herein. FIG. 19 illustrates a tab strip member 208 having a vertical portion 210, ramp 212, and horizontal portion 214 similar to the strip shown in FIG. 17. However, the tab of FIG. 19 is integrally formed and is offset like the tab in the strip of FIG. 18. FIG. 20 illustrates yet another tab strip member 216 which is similar to the strip of FIG. 19, except that it contains an upper horizontally extending tab 218, in addition to the lower horizontally extending tab 220, which is formed out of part of the vertical portion 222 and ramp 224 of this strip. The upper tab 218 is coplanar with rather than offset from the horizontal portion 226.

FIG. 21 illustrates a tab strip member 228 which may be fastened to the edge of a roof using masonry fasteners 230 or the like.

FIG. 22 illustrates a tab strip member 232 wherein tabs 234 are punched out from the underside of a horizontal portion 236 so as to be coplanar with the horizontal portion. A vertical portion 238 extends upwardly from and is generally perpendicular to the horizontal portion 236. FIG. 23 illustrates a somewhat similar tab strip member 240 having tabs punched out from underneath, wherein a first set of tabs 242 is coplanar with a horizontal portion 244 and a second set of tabs 246 is coplanar with a vertical portion 248. This type of configuration would aid in aligning the strip on the corner of a block wall, since the horizontal portion 244 and tabs 246 would help position the strip.

Figure 24:
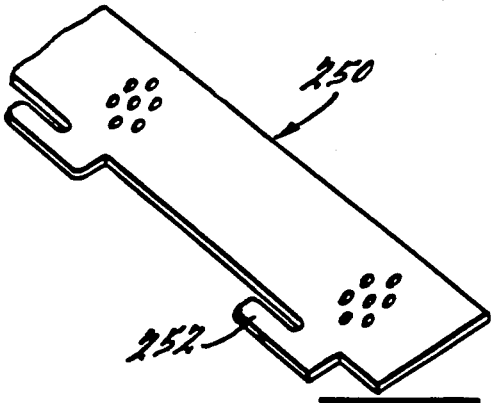
Figure 25:
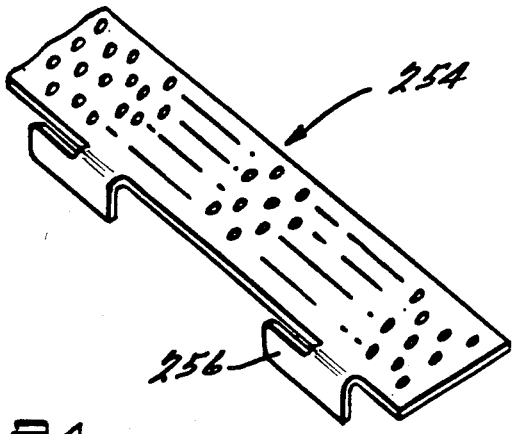
Figure 26:
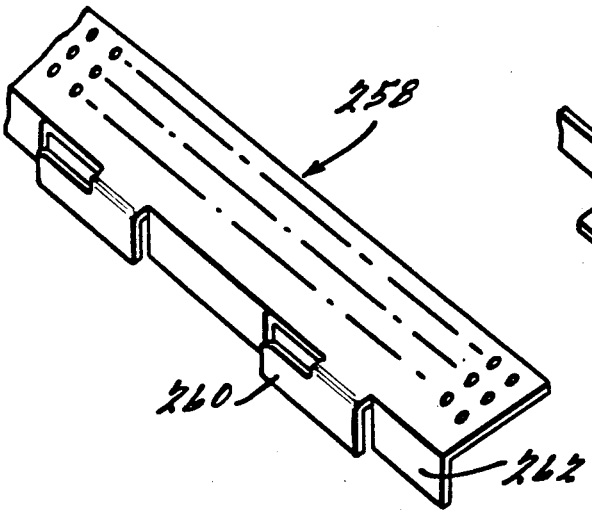

FIG. 24 illustrates a tab strip member 250 wherein tabs 252 are generally hook-shaped. Such a configuration would allow the slots of a mating cant member or spring clip member to be placed over the tabs and then shifted laterally to help insure that the cant member is attached once the tabs are bent over. FIG. 25 illustrates a somewhat similar tab strip member 254 in which the tabs 256 are both hook-shaped and bent over prior to installation of a mating cant member. Thus a cant member would be secured solely by a lateral shift rather than by bending over any tabs, as is the case in most of the other embodiments shown herein. FIG. 26 illustrates a tab strip member 258 in which bent over, hook-shaped tabs 260 are offset from a vertical portion 262 to provide a gap and give more clearance for lateral movement of a mating cant member.

Figure 27:
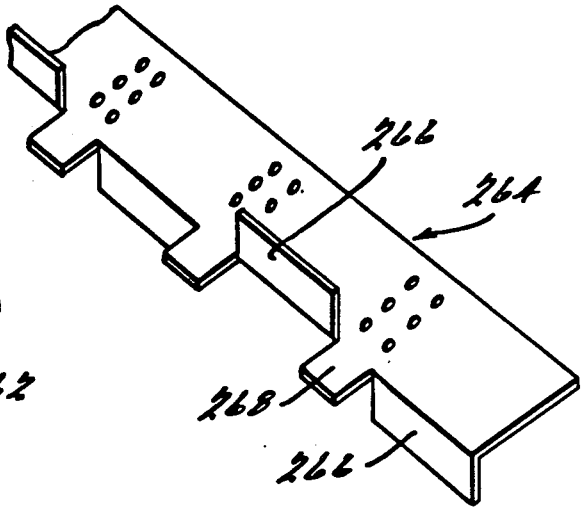
Figure 28A:
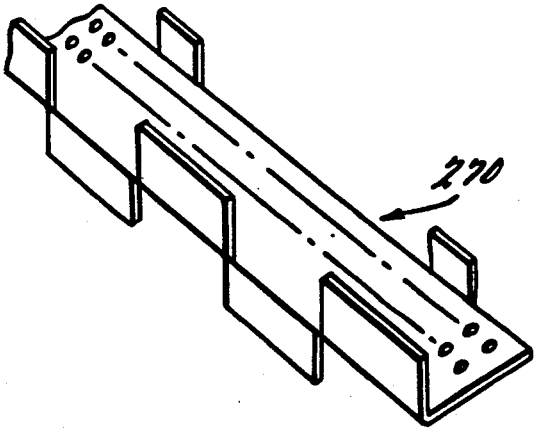
FIGS. 28*a* and 28*b* show yet another configuration of the nailerless roof edge assembly of the present invention.
Figure 28B:
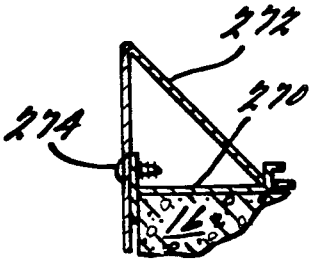

FIG. 27 illustrates a tab strip member 264 wherein upwardly and downwardly directed vertical flaps 266 alternate direction between tabs 268. In a further modified form of this configuration, FIG. 28*a* illustrates a tab strip member 270 similar to the strip of FIG. 27 except with no protruding tabs on its face. As seen in FIG. 28*b*, a cant member 272 would be secured to the tab strip member 270 using such manual tabbing means 274 as screws, pop-rivets, or the like. Holes or slot means would be provided in the mating cant member to receive the screws or rivets.

The tab strip member, cant member, and fascia member used with the present invention may be made of such material as galvanized steel sheet. Besides galvanized metal, aluminum, stainless steel, plastic, or the like may also be used. The various components may also be painted or coated as necessary for both protective and decorative purposes. Needless to say, the tab strip member should be relatively flexible or ductile so that the tabs thereon can be bent over without too much effort. Also, the tab strip member should be flexible enough to be able to deform or compensate for any irregularities in the cement blocks or concrete.

Among the advantages of the present invention, in addition to those described above, is that since a wood nailer is no longer necessary along the roof edge, the cost of material and labor of installing wood nailers is eliminated, and furthermore there is no concern for rotting wood. Since the roof edge assembly of the present invention comprises parts made from sheet metal or the like, the roof edge assembly allows any insulation layer to breathe at the roof edge where it counts most. The usual problem of trapped water is likewise virtually eliminated. The nailerless roof edge assembly of the present invention also provides for simple, fast and economical installation, but yet has been shown to provide respectable holding power of about 200 pounds per foot in certain constructions. Since the installation of the nailerless roof edge assembly of the present invention would probably be the responsibility of a single contractor, namely a sheet metal worker or the like, no carpenters, masons, or steel workers would be needed. Job scheduling is thus simplified, as is the time necessary for completion of various jobs. The relative simplicity of the assembly and installation procedure likewise makes it ideal for renovation, or repair work, as well as new construction.

Although most of the description of the present invention given above has been directed to a roof edge assembly, it should be appreciated that the principles of the invention are equally applicable to other edges on building structures, such as corners, windows, doorways, or the like. Furthermore, the invention is also useful in securing siding, partitions, curtain walls, and the like to wall surfaces, without the need for nails. In this regard reference may be had to FIGS. 29–34, which illustrate further uses of the invention in securing window frames (or door frames) to a building structure; and also to FIGS. 35–36, which illustrate use of the invention to secure building panels, curtain walls, siding, partitions and the like to wall surfaces.

Figure 29:
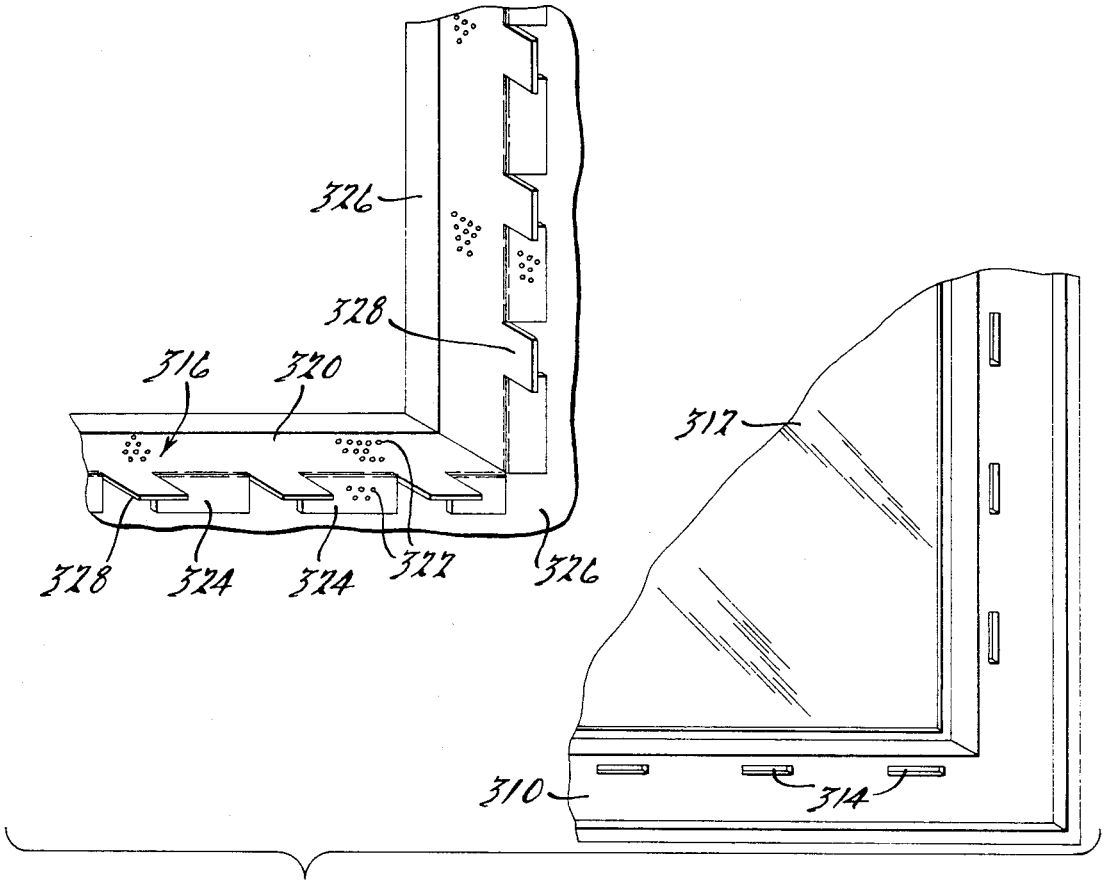
FIG. 29 is an exploded perspective view of a first embodiment of framing assembly.
Figure 30:
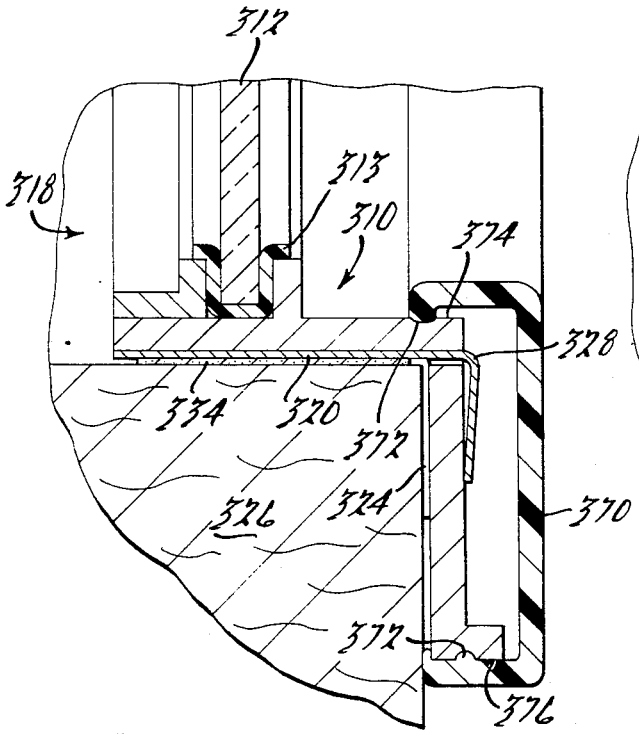
FIG. 30 is a cross sectional view of the framing assembly of FIG. 29, showing frame member assembled on tab strip member.

Referring to first to FIGS. 29 and 30, a first embodiment of framing structure is illustrated. Although the illustrated embodiment depicts a window and window frame, it will be understood that the principles of the invention may be extended to framing other openings within a building structure, such as for framing doorways. Accordingly, a window frame is illustrated generally at 310 for illustration purposes only. Window frame 310 is provided with a pane of glass 312 and sealant structure 313 in the usual fashion. Where applicable, like reference numerals will be used to describe similar components in different embodiments, thus window frame 310 is provided with slotted openings 314 which are preferably evenly spaced about the window frame. In accordance with the invention a tab strip member 316 is constructed as shown in FIG. 29 and adapted for being inserted into the window opening 318 and held in place with adhesives 334. If desired, tab strip member 316 can be provided as a continuous strip, which can then be cut to length or bent as needed to fit a particular shape and size of window opening. Alternatively, the tab strip member 316 can be preformed to a given window shape and size.

With continued reference to FIGS. 29 and 30, tab strip member 316 has a flat face portion 320 which is provided with a plurality of perforations 322, which allow the adhesive to grip the strip better, as described above. At regularly spaced intervals the tab strip member is provided with flanges 324, generally perpendicular to the face portion thereof. The face portion 320 and flanges 324 thus define a right angular structure for abutting engagement with the edges of a building defined by the surfaces adjacent the window opening. In FIGS. 29–32 the building structure is indicated generally by reference numeral 326. Tab strip member 316 is also provided with a plurality of outwardly protruding tabs 328, which are adapted for insertion in the slotted openings 314 along window frame 310. The tab strip member is comprised of a relatively flexible and ductile material, such as aluminum, and tabs 328 may be bent to lock the window frame in place after the tabs have been inserted in slotted openings 314. Preferably flanges 324 are also provided with perforations 322 to allow the tab strip member to adhere strongly to the building structure.

The framing structure of the invention further includes a cover member 370 which is adapted for snap-fitting engagement with window frame 310. Cover member 370 is illustrated in FIG. 30 (and also FIG. 32), but has been omitted from FIG. 29 (and also FIG. 31) in order to better illustrate the invention. Cover member 370 is generally channel shaped in cross section and is provided with detent or nub structures 372 for engaging first and second edges 374 and 376 of the frame 310. The detents of cover member 370 snap into recesses formed along edges 374 and 376, to hold cover member 370 in place, thereby concealing the folded over tab 328.

Figure 32:
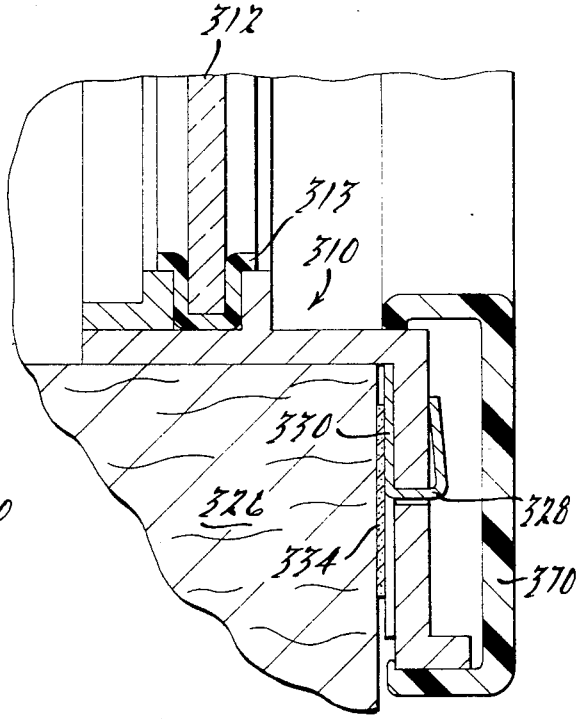
FIG. 32 is a cross sectional view of the framing member of FIG. 31, showing frame member assembled on tab strip member.
Figure 31:
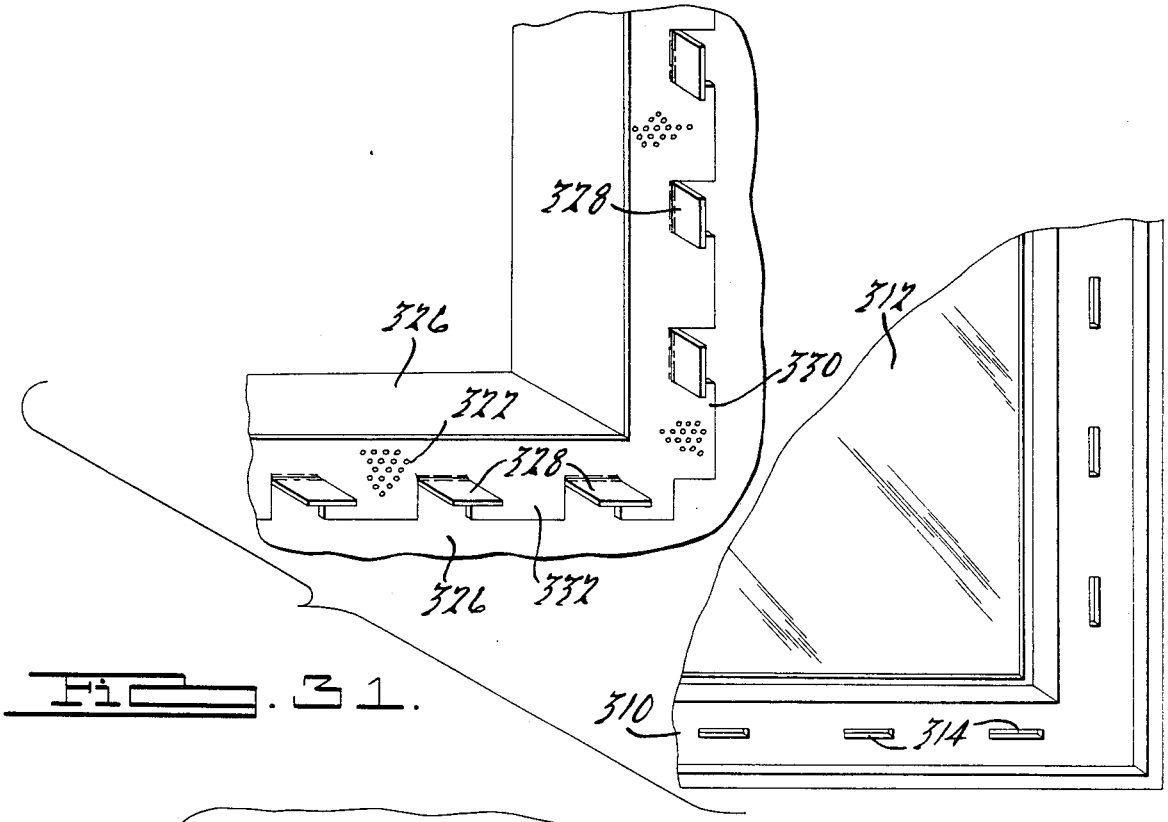
FIG. 31 is an exploded perspective view showing another embodiment of framing member.

A second, slightly modified, embodiment of framing structure is illustrated in FIGS. 31 and 32. In this slightly modified embodiment the tab strip member 330 has a face portion 332 adapted for being adhered to the outwardly facing side of the building structure adjacent the window opening using adhesive 334. Protruding outwardly at right angles from face portion 332 are a plurality of equally spaced tabs 328, which may be bent over as described above to lock window frame 310 in place. As illustrated, the slotted openings 314 of this second embodiment are disposed somewhat further away from the edge of glass 312. The tabs 328 of the first embodiment lie essentially flush with the face portion 320, whereas the tabs 328 of the second embodiment protrude from approximately the center line of face portion 332. This second embodiment is also provided with cover member 370, shown in FIG. 32, contructed essentially as described above.

Figure 33:
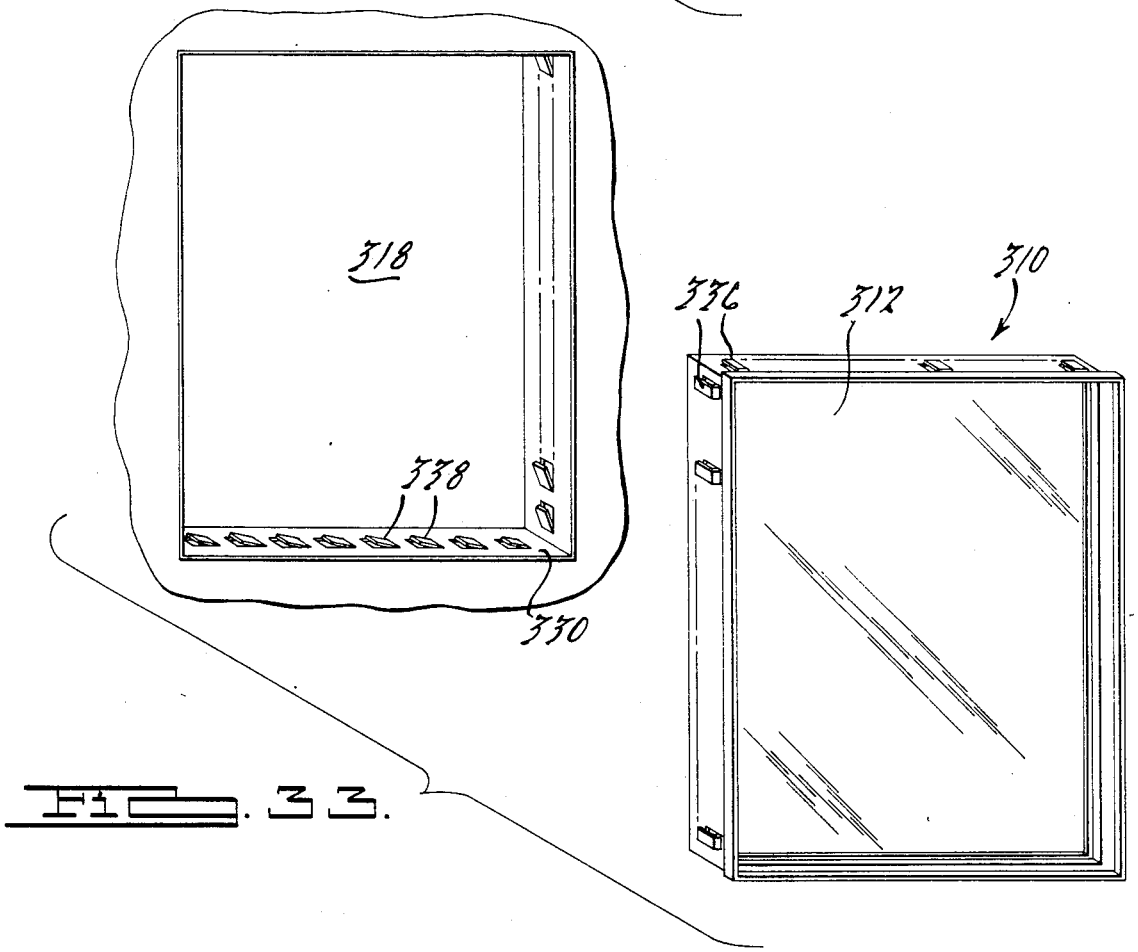
FIG. 33 is an exploded perspective view of yet another embodiment of framing member in accordance with the present invention.
Figure 34:
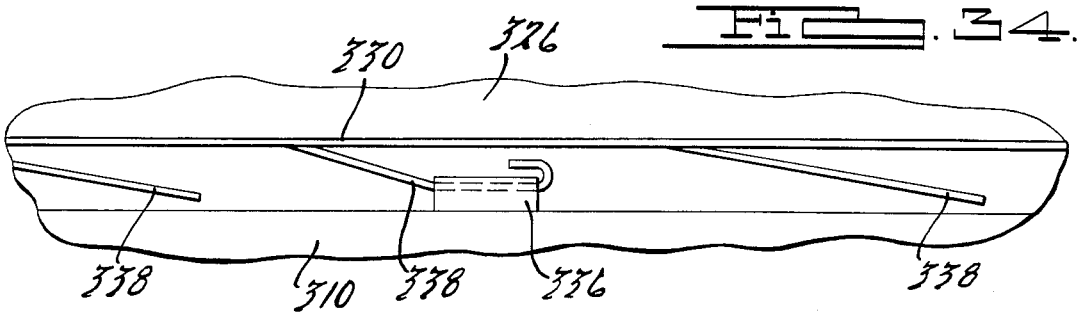
FIG. 34 is a detailed plan of the framing member and tab strip member of the embodiment of FIG. 33.

Yet another embodiment of the invention is illustrated in FIGS. 33 and 34. In this alternate embodiment window frame 310 is provided around the periphery thereof with a plurality of clips 336. The clips are preferably integral with the window frame and extend or protrude outwardly from the side faces of the window frame. The clips are elongated and are attached at one end thereof to the window frame. The other end is unattached and defines an opening for receiving the tabs 338 of the tab strip member 330. As illustrated in FIG. 33, the clips 336 are oriented to open rearwardly, so that the window frame 310 may be slideably inserted through the window opening 318, causing at least a portion of the clips 336 and tabs 338 to engage one another. If desired, the tabs 338 may then be bent or folded over clips 336, using pliers, screwdriver, pry bar or the like.

FIG. 34 shows the engagement of a clip 336 and a tab 338 in greater detail. As illustrated, tab 338 has been bent backwardly or folded over clip 336 to better lock window frame 310 to building 326. Although not illustrated in FIG. 34, it will be understood that tab strip member 330 is secured to building 326 using mastic or another comparable adhesive.

Figure 35:
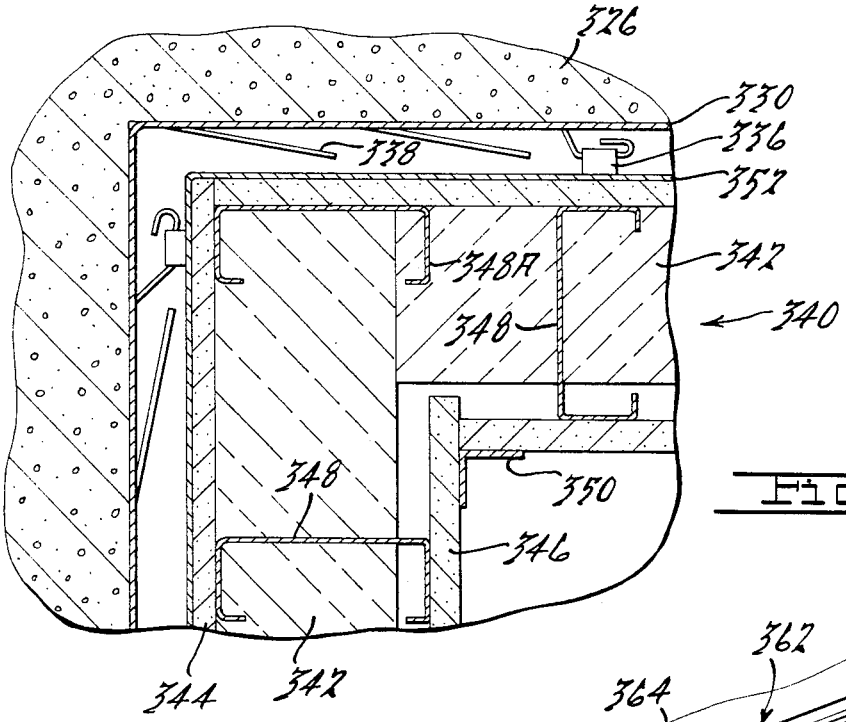
FIG. 35 is a cross sectional view showing a building panel mounting assembly in accordance with the present invention, useful for securing partitions and other building structures to a masonry wall.

FIG. 35 illustrates another embodiment of the invention, useful in securing building materials, such as partition walls, to a building structure. In FIG. 35 the building structure is denoted generally by reference numeral 326. Building 326 may be constructed of any building material, including stone, brick, cement block and other masonry surfaces, and also metal, plaster or plaster board and wood materials, to name but a few. The invention is particularly well suited for use on building surfaces which cannot be nailed to.

With continued reference to FIG. 35, a partition 340 is shown attached to building 326 in accordance with the invention. It will be understood, however, that the partition 340 illustrated in FIG. 35 is merely exemplary of one type of building material which can be secured to the surface of a building using the invention. Briefly, partition 340 includes a core material 342, preferably having insulative qualities, an outer shell surface 344 and an inner shell surface 346. The outer and inner shell surfaces may be held together using steel studs 348. Similar steel studs may also be used to hold sections of the partition together and to form corners, as illustrated at 348A. The corners formed by adjoining inner shell surfaces may be protected using corner reinforcement tape 350, or the like.

In accordance with the invention partition 340 is secured to building 326 using one or more tab strip members 330, having outwardly protruding tabs 338, similar to the tab strip member of FIGS. 33 and 34. The outer shell surface 344 is provided with a plurality of clips 336, which may be integrally formed on or secured to a metal band 352, which is in turn secured to the outer shell surface 344. As illustrated, the tabs may be folded or bent over to lock the partition in place. In many instances, folding or bending the tabs is optional, because the weight of the partitions alone will serve to hold the partitions in place. When this method is used, the partitions can be later removed by applying an upward lifting force sufficient to disengage the clips 336 from the corresponding tabs 338.

Figure 36:
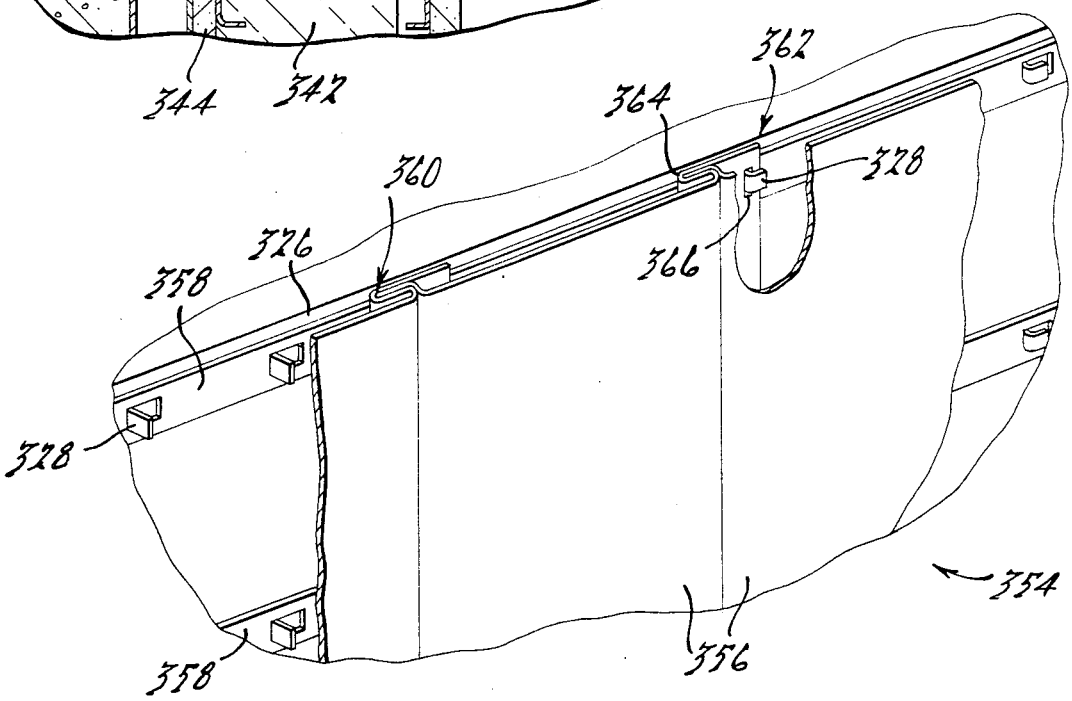

FIG. 36 illustrates yet another embodiment of the invention wherein a curtain wall 354 is secured to building 326. As illustrated, curtain wall 354 is assembled from a plurality of interlocking building panel sections 356. It will of course be recognized, however, that the invention may be practiced using other types of building panels, siding, and the like. Furthermore, while the illustrated curtain wall sections 356 are generally vertically arranged to define vertical seams, the invention may also be used with building panel sections arranged horizontally to define horizontal seams.

In accordance with the invention one or more tab strip members 358 are secured with adhesive to the building 326. Tab strip member 358 comprises a generally elongated flat strip having a plurality of evenly spaced outwardly protruding tabs 328 generally perpendicular to the plane of the strip. Building panel sections 356 are provided with first and second parallel edges 360 and 362, respectively. The first edge is bent to define an offset flange, while the second edge 362 is bent to define a reentrant, S-shaped channel element 364 adapted to receive the first edge 360. In this fashion, a plurality of similarly constructed panel sections are interfitted together to form the curtain wall. The sections 354 are further provided with slotted openings 366 disposed along the second edge 362 and adapted for receiving tabs 328. When assembling the curtain wall, one or more tab strip members 358 would be secured with adhesive to building 326 in spaced apart strips corresponding to the spacing between slotted openings 366. A first panel section would then be installed by aligning the slotted openings with tabs 328 and then bending tabs 328 over to secure the first panel. Then a second panel would be installed by inserting its first edge 360 into the channel element 364 of the previously installed panel, while aligning its slotted openings with the corresponding tabs. Being somewhat flexible themselves, the panel sections provide enough resilience so that a second panel section can be flexed and inserted into the channel element of the previous panel and then rotated or unflexed into position where the second panel can be slipped on its corresponding tabs. Notably, the second panel section completely covers the folded over tabs 328 used to hold the previous panel section. Thus when the installation is complete, only the final panel section will require a conventional molding strip to hide the final set of tabs.

While it will be apparent that the preferred embodiments of the invention disclosed are well calculated to fulfill the objects above stated, it will be appreciated that the invention is susceptible to modification, variation, and change without departing from the proper scope or fair meaning of the subjoined claims.

I claim:

1. In a kit for an assembly for mounting a framing member to a building at an opening through a surface of the building, the building surface generally defining an outwardly facing plane, comprising:

a tab strip member having an attachment portion for securing to said building adjacent said opening and having tab means integral with said attachment portion;

said tab means extending outwardly from and orthogonally to the plane of said building surface when said tab strip member is secured to said building;

a frame member having integrally formed slot means for receiving said tab means by sliding said frame member in a direction orthogonal to the plane of said building until a portion of said tab means protrudes through said slot means;

said frame member being supported by said tab means when slidably received by said tab means and said tab means being permanently bendable to prevent removal of said frame member; and cover member attachable to an outwardly exposed portion of said frame member for concealing said protruding portion of said tab means.

2. The assembly of claim 1 wherein said attachment portion is securable directly to said building surface.

3. The assembly of claim 1 wherein the building at said opening defines two intersecting surfaces and said attachment portion is directly attachable to both of said surfaces.

4. The assembly of claim 1 wherein said attachment portion is provided with perforations for use in securing said attachment portion to said building with adhesives.

5. The assembly of claim 1 wherein said tab strip defines a longitudinal dimension and wherein said tab means comprise a plurality of tab members disposed at spaced intervals along said longitudinal dimension.

6. The assembly of claim 5 wherein said frame member has a plurality of slots disposed at spaced intervals around the periphery for receiving said tab members.

7. In a kit for an assembly for securing a building panel to a building surface which generally defines an outwardly facing plane, comprising:

a tab strip member having an attachment portion for securing to said building surface and having tab means integral with said attachment portion;

said tab means extending outwardly from and generally orthogonally to the plane of said building surface when said tab strip member is secured to said building;

a building panel having integrally formed slot means for receiving said tab means by sliding said panel in a direction generally orthogonal to the plane of said building until a portion of said tab means protrudes through said slot means;

said building panel being supported by said tab means when slidably received by said tab means and said tab means being permanently bendable to prevent removal of said frame member; and said building panel having a first edge adjacent said slot means and having a second edge parallel to said first edge; and said building panel having a re-entrant bend adjacent said first edge for slidably receiving the second edge of another similarly constructed building panel which thereby covers and conceals said tab means.

8. The assembly of claim 7 wherein said attachment portion is securable directly to said building surface.

9. The assembly of claim 7 wherein the building at said opening defines two intersecting surfaces and said attachment portion is directly attachable to both of said surfaces.

10. The assembly of claim 7 wherein said attachment portion is provided with perforations for use in securing said attachment portion to said building with adhesives.

11. The assembly of claim 7 wherein said tab strip defines a longitudinal dimension and wherein said tab means comprise a plurality of tab members disposed at spaced intervals along said longitudinal dimension.

12. The assembly of claim 7 wherein said frame member has a plurality of slots disposed at spaced intervals around the periphery for receiving said tab members.

13. In a kit for an assembly for use in securing a building material to a building surface which defines an outwardly facing plane, comprising:

a tab strip member having an attachment portion for securing to said building surface and having tab means integral with said attachment portion;

said tab means extending outwardly and laterally at an acute angle from the plane of said building surface when said tab strip member is secured to said building;

a securing band for attachment to said building material, said band having clip means extending away from said building material and downwardly; and said clip means being orthogonally and overlappingly engageable with said tab means to thereby support said building material on said building surface.

14. The assembly of claim 13 wherein said tab strip member defines a longitudinal dimension and wherein said tab means comprises a plurality of tab members equally spaced along said longitudinal dimension.

15. The assembly of claim 13 wherein said securing band defines a longitudinal dimension and wherein said clip means comprises a plurality of downwardly extending clip members equally spaced along the longitudinal dimension.

16. The assembly of claim 13 wherein said tab means comprises a plurality of laterally extending tab members at equally spaced lateral intervals, wherein said clip means comprises a plurality of downwardly extending clip members at laterally spaced intervals.

17. The assembly of claim 16 wherein said tab members are at more closely spaced intervals than said clip members.

* * * * *

UNITED STATES PATENT AND TRADEMARK OFFICE

CERTIFICATE OF CORRECTION

PATENT NO. : 4,617,770

DATED : October 21, 1986

INVENTOR(S) : John B. Hickman

It is certified that error appears in the above-identified patent and that said Letters Patent is hereby corrected as shown below:

| | | |
|---|---|---|
| Column | 2, line 22 | "tap" should be -- tab --. |
| Column | 3, line 30 | "masonary" should be -- masonry --. |
| Column | 5, line 17 | "after the word "whereas" -- delete "a" --. |
| Column | 5, line 22 | "after "needed",, should be -- needed, --. |
| Column | 6, line 58 | "be" should be -- of --. |
| Column | 7, line 67 | "forward" should be -- formed --. |

UNITED STATES PATENT AND TRADEMARK OFFICE

CERTIFICATE OF CORRECTION

PATENT NO. : 4,617,770

DATED : October 21, 1986

INVENTOR(S) : John B. Hickman

It is certified that error appears in the above-identified patent and that said Letters Patent is hereby corrected as shown below:

| | | |
|---|---|---|
| Column 9 | line 51 | "After the word "referring" -- delete "to", first occurrance. |
| Column 12, | line 6 | "reentrant" should be -- re-entrant --. |

Signed and Sealed this

Twenty-eighth Day of April, 1987

*Attest:*

DONALD J. QUIGG

*Attesting Officer*

*Commissioner of Patents and Trademarks*